US006573803B1

(12) United States Patent
Ziegner et al.

(10) Patent No.: US 6,573,803 B1
(45) Date of Patent: Jun. 3, 2003

(54) SURFACE-MOUNTED MILLIMETER WAVE SIGNAL SOURCE WITH RIDGED MICROSTRIP TO WAVEGUIDE TRANSITION

(75) Inventors: Bernhard Alphonso Ziegner, Tyngsborough, MA (US); Robert John Sletten, Bow, NH (US); Stephen R. Brown, Derry, NH (US); May Kyi Cho, Sudbury, MA (US); Noyan Kinayman, Malden, MA (US)

(73) Assignee: Tyco Electronics Corp., Middletown, PA (US)

( * ) Notice: Subject to any disclaimer, the term of this patent is extended or adjusted under 35 U.S.C. 154(b) by 0 days.

(21) Appl. No.: 09/689,295

(22) Filed: Oct. 12, 2000

(51) Int. Cl.[7] ..... H01P 5/107
(52) U.S. Cl. ..... 333/26; 333/34
(58) Field of Search ..... 333/26, 246, 33, 333/34

(56) References Cited

U.S. PATENT DOCUMENTS

| | | | | |
|---|---|---|---|---|
| 2,825,876 A | | 3/1958 | Le Vine et al. | 333/34 |
| 3,969,691 A | | 7/1976 | Saul | 333/21 R |
| 4,754,239 A | | 6/1988 | Sedivec | 333/26 |
| 5,262,739 A | * | 11/1993 | Dalman | 333/26 |
| 5,808,519 A | * | 9/1998 | Gotoh et al. | 333/26 |
| 5,982,250 A | * | 11/1999 | Hung et al. | 333/26 |
| 6,028,497 A | | 2/2000 | Allen et al. | 333/246 |
| 6,087,907 A | | 7/2000 | Jain | 333/26 |

* cited by examiner

*Primary Examiner*—Benny Lee

(57) ABSTRACT

A surface-mountable mm-wave signal source is provided. The surface-mountable mm-wave signal source comprises: a conductive metal base; a mm-wave signal source disposed over an upper portion of the metal base; a first radio frequency transmission line carrying a quasi-TEM signal from the mm-wave signal source, which is disposed over an upper portion of the metal base and proximate the signal source; a first mode transformer at least partially integrated into the upper portion of the metal base to convert the quasi-TEM signal carried by the planar transmission line into a rectangular waveguide mode signal; a waveguide well having upper and lower ends disposed within the base for carrying the rectangular waveguide mode signal from an upper portion of the base to a lower portion of the base; and a second mode transformer at least partially integrated into the lower portion of the base to convert the rectangular waveguide mode signal to a quasi-TEM signal within a second radio frequency transmission line. The mm-wave signal source preferably operates in a frequency range of from 35 to 94 GHz, more preferably a frequency range of 70 to 80 GHz.

28 Claims, 8 Drawing Sheets

SURFACE-MOUNTED MILLIMETER WAVE SIGNAL SOURCE WITH RIDGED MICROSTRIP TO WAVEGUIDE TRANSITION

FIELD OF THE INVENTION

This invention relates to surface mounted packages for millimeter wave circuits.

BACKGROUND

There is growing demand for very compact, low-cost, millimeter wave communications and sensor circuits. In response to this demand, such circuits frequently use millimeter wave signal sources, which typically involve components and circuitry contained on dielectric (e.g., glass, plastic or ceramic) substrates.

At present, millimeter wave (mm-wave) signal sources are based on package designs that feature waveguide flange output ports or coaxial connector output ports. Such designs, however, are inappropriate for surface mounting. Surface mounting is desirable, for example, because it greatly simplifies manufacturing (e.g., components can be reflow solder attached to a circuit board or other substrate) and because it reduces the cost of the product and allows increased productivity.

Indeed, at present, no means are known to the present inventors by which a mm-wave signal source can be surface mounted to a printed-circuit board (PCB).

SUMMARY OF THE INVENTION

The above and other deficiencies in the prior art are addressed by the present invention. According to an embodiment of the invention, a surface-mountable mm-wave signal source is provided. The surface-mountable mm-wave signal source comprises:

(a) a conductive metal base;

(b) a mm-wave signal source disposed over an upper portion of the metal base;

(c) a first radio frequency transmission line carrying a quasi-transverse electric mode ("quasi-TEM") signal from the mm-wave signal source, which is disposed over an upper portion of the metal base and proximate the signal source;

(d) a first mode transformer at least partially integrated into the upper portion of the metal base to convert the quasi-TEM signal carried by the planar transmission line into a rectangular waveguide mode signal;

(e) a waveguide well having upper and lower ends disposed within the base for carrying the rectangular waveguide mode signal from an upper portion of the base to a lower portion of the base; and (f) a second mode transformer at least partially integrated into the lower portion of the base to convert the rectangular waveguide mode signal to a quasi-TEM signal within a second radio frequency transmission line.

The mm-wave signal source preferably operates in a frequency range of from 35 to 94 GHz, more preferably a frequency range of 70 to 80 GHz.

The mm-wave signal source, the first radio frequency transmission line and the mode transformer are preferably disposed within a metal cover over the upper portion of the base, which is preferably attached to the base by a solder or by a conductive adhesive.

At least one feed-through is typically provided, by which power or control signals can be transmitted between the lower portion of the base and the upper portion of the base. Preferably, the feed-through further comprises a conductive pin disposed within a dielectric insert, and the dielectric insert occupies a slot formed between the upper and lower portions of the base.

The mm-wave signal source, the first radio frequency transmission line (preferably a microstrip line) and at least portions of the first mode transformer are also preferably disposed on one or more dielectric substrates. The one or more dielectric substrates are typically attached to the base by a conductive epoxy.

Preferably, the first mode transformer comprises a glass substrate provided with a layer of patterned electrically conductive material and disposed over both (a) a shallow step region formed in an upper surface of the base and (b) the upper end of the waveguide well. The patterned electrically conductive material preferably comprises transforming fins for converting the quasi-TEM signal into the rectangular waveguide mode signal.

The second mode transformer preferably comprises an angled reflector and a tapered ridge transition. The angled reflector is disposed at the lower end of the waveguide well and reflects the waveguide mode signal onto the tapered ridge transition. The tapered ridge transition is shaped to convert the rectangular waveguide mode signal to a quasi-TEM signal within an adjacent microstrip line. The angled reflector and the tapered ridge transition are preferably integrated into the base.

The surface-mountable mm-wave signal source preferably includes a plurality of projections integrated into a lower surface of the base. In many preferred embodiments, at least one of these projections substantially surrounds the angled reflector and the tapered ridge transition.

Lower surfaces of the tapered ridge transition, the feed-throughs and the projections are preferably provided with a layer of solder, for ease of mounting.

The metal in the base of the surface mountable mm-wave signal source is preferably selected from (a) 85% tungsten/l 5% copper alloy, (b) 94% tungsten/2% nickel/2% iron/2% copper alloy, and (c) a stainless steel alloy. Although other fabrication techniques can be used, the base is preferably formed by metal injection molding.

According to another embodiment of the invention, a mm-wave electronic circuit is provided which comprises: (a) the above-described surface-mountable mm-wave signal source coupled to (b) a printed circuit board, which includes the above-noted second radio frequency transmission line. The second radio frequency transmission line is preferably a microstrip line formed on the printed circuit board.

The second mode transformer preferably comprises an angled reflector and a tapered ridge transition, wherein (a) the angled reflector is disposed at the lower end of the waveguide slot and reflects the rectangular waveguide mode signal to the tapered ridge transition, (b) the tapered ridge transition is coupled to the microstrip line formed on the printed circuit board, and (c) the tapered ridge transition acts to convert the rectangular waveguide mode signal into a quasi-TEM signal within the microstrip line formed on the printed circuit board.

The circuit board preferably comprises metallization for power and/or signal transmission and metallization for grounding and heat transfer. The metallization for power and/or signal transmission is coupled to the at least one feed-through and the metallization for grounding and heat transfer is coupled to at least portions of the base. Preferably, solder or conductive adhesive is used: (a) to couple the tapered ridge transition to the microstrip line formed on the printed circuit board, (b) to couple at least one feed-through to the metallization for power or signal transmission, and (c) to couple at least portions of the base to the metallization for grounding and heat transfer.

One advantage of the present invention is that a mm-wave source can be surface mounted to a printed circuit.

Another advantage of the present invention is that it greatly simplifies the manufacturing of the associated mm-wave PCB assembly.

These and other embodiments and advantages of the present invention will become immediately apparent to those of ordinary skill in the art upon review of the Detailed Description and Claims to follow.

DETAILED DESCRIPTION OF THE INVENTION

Several preferred embodiments of the present invention will now be described. This invention may, however, be embodied in different forms and should not be construed as limited to the embodiments set forth herein.

Figure 1:
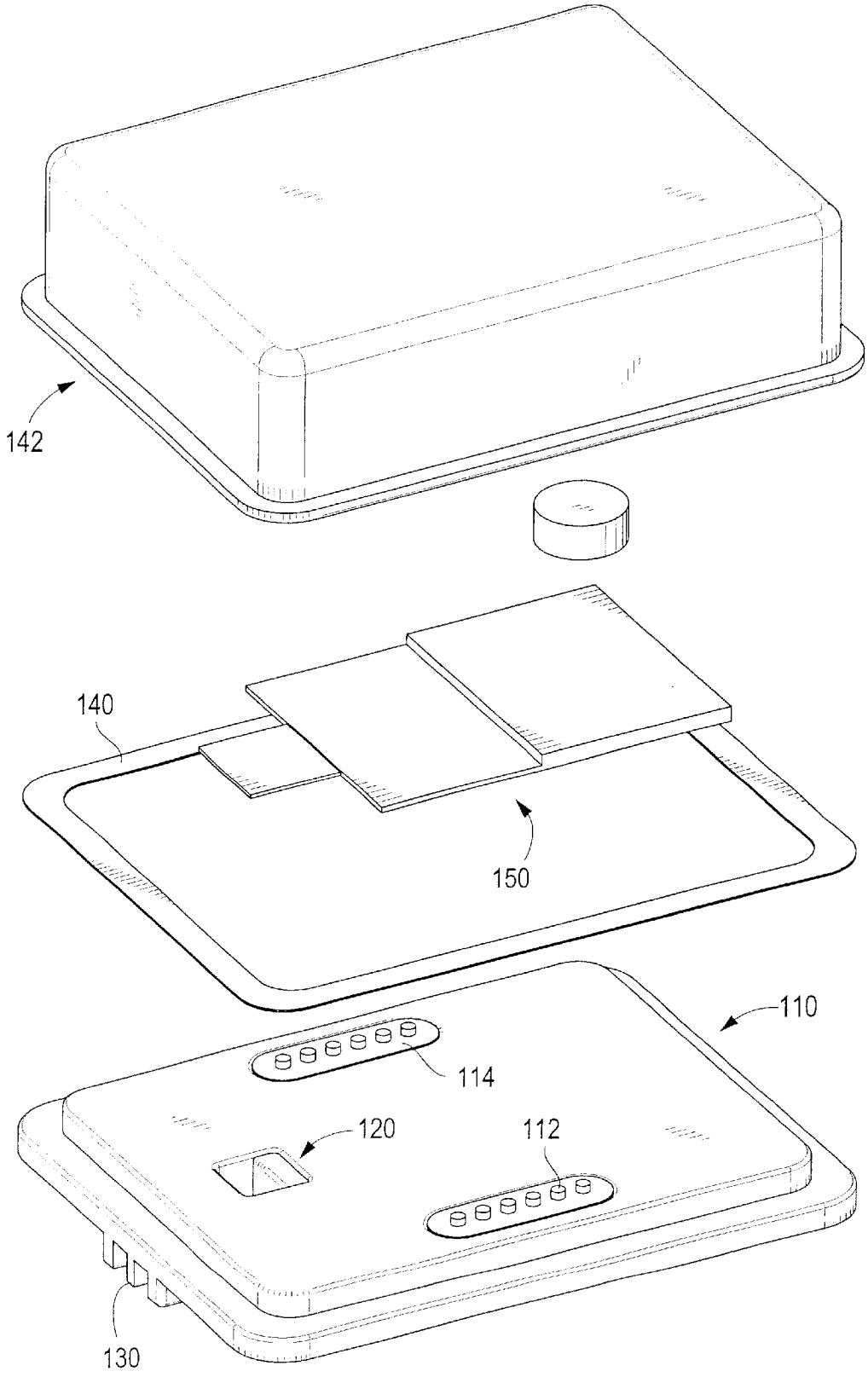
FIG. 1 is an exploded view of a surface mounted mm-wave source, according to an embodiment of the present invention.

FIG. 1 is an exploded view of a surface mounted mm-wave source according to an embodiment of the present invention. The source is appropriate for frequencies greater than 24 GHz, where physical dimensions are reasonable for solder reflow surface mount assembly. A 76 GHz signal source is being described herein as a typical representation of the embodiment. The surface mounted mm-wave source comprises a base 110, mm-wave circuit components 150, including a waveguide launch feature, an electrically conductive seal 140, and a cover 142.

The base 110 includes feed-throughs in the form of conductive pins 112, which are electrically isolated from the base 110 by dielectric inserts 114. The feed-throughs are provided, for example, to allow power and control signals to be passed between a printed circuit substrate, to which the surface mounted signal source is attached (typically a rigid printed circuit such as a Duroid™ circuit board, Rogers Corporation, Microwave Materials Division, not shown), on the lower side of the base 110 and the electronic circuit components 150 on the upper side of the base 110.

In the embodiment shown in FIG. 1, the conductive pins 112 are suitable for wire bonding on one side and solder attachment on the other. The conductive pins 112 can be made of any conductive material commonly used for these purposes, preferably a metal such as beryllium-copper for a plastic feed-through or a nickel-iron alloy for a glass or ceramic feed-through.

The dielectric inserts 114 can be made of essentially any dielectric material such as a plastic, glass or ceramic material, with a ceramic material such as alumina being preferred to achieve a hermetic seal.

The base 110 is provided with a microstrip-to-waveguide transition region 120 and a waveguide-to-microstrip transition feature 130 (also referred to herein as a "tapered ridge transition") which are discussed in detail below.

The base 110 provides heat transfer and shielding (in this case EMI/RFI shielding) functions. Preferred materials for this purpose are metals and metal alloys. To reduce thermal joint stresses, the metal or metal alloy preferably has a coefficient of thermal expansion that closely matches that of (1) the electronic circuitry 150 and (2) the printed circuit substrate to which the surface mounted source mm-wave source is to be attached. Most preferred materials are tungsten-copper in the range of 5 to 7 parts per million per degree Centigrade (° C.) of thermal expansion coefficient and 150 to 200 Watts/meter° C. in thermal conductivity. Other materials such as NiFe alloys could be used if thermal conductivity is not considered important.

A preferred process for forming the base 110 is metal injection molding, which is a technique well known in the art. Metal injection molding processing is advantageous in that small parts with complex features can be made with tight dimensional tolerances, at low cost and in volume. Numerous metal injection-molding fabricators are in businesses that are experienced in making parts like those used in the present invention. The formed metal cover 142 provides both mechanical protection and shielding for the mm-wave circuit components 150 attached to the base 110. The formed metal cover 142 is typically of a nickel-iron alloy such as F15, or it can be of the same material as that of the base 110 and formed using metal injection molding techniques. Dimensional tolerances are less exacting for the cover 142 than for the base 110. Hence a greater number of processes are appropriate for the manufacture of the same, including coined metal processes and deep-drawing methods for formed metal. Welding of the cover to the base can also be employed.

A seal 140 is provided between the cover 142 and the base 110. The seal 140 is preferably designed to adhere the cover 142 to the base 110, while also providing shielding. Preferred seals 140 for this purpose include metal filled adhesives and solders. Preferred meal filled adhesives are silver-filled epoxies, while preferred solders are lead-based solders, such as lead-tin solders.

Figure 2:
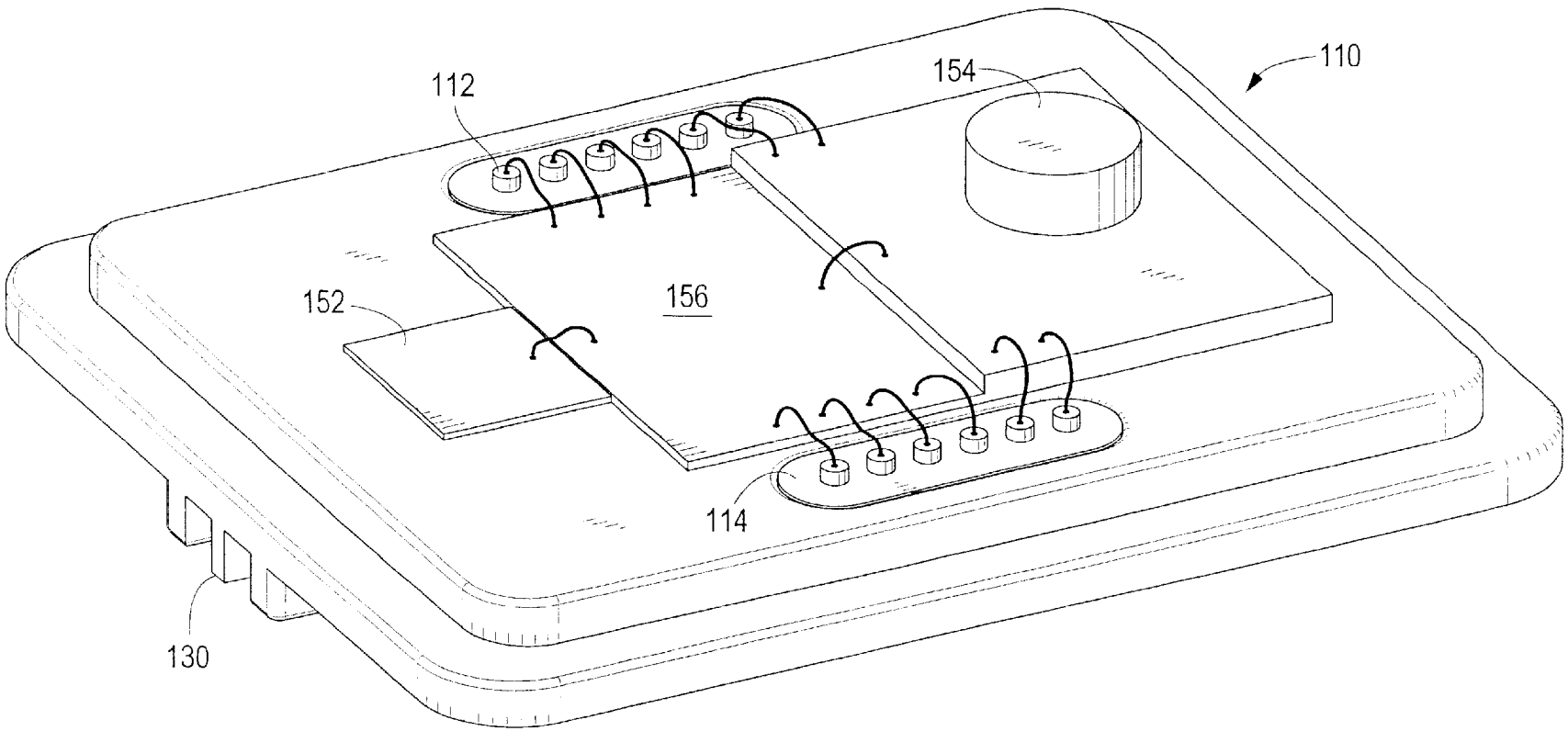
FIG. 2 shows the mm-wave circuit components of FIG. 1 in place on the top-side of base with representative connections to the power and control feed-through connectors.

FIG. 2 shows the mm-wave circuit components of FIG. 1 in place on the top side of base 110. A mm-wave signal source consisting of an oscillator circuit 154 (specifically, a dielectric resonator oscillator) and an amplifier/multiplier circuit 156 are shown in this particular embodiment.

Numerous signal sources are useful in connection with the present invention including Gunn oscillators, MESFET oscillators and pHEMT oscillators as well as oscillators/multipliers. Also shown is launch feature 152. The launch feature 152 is positioned over the microstrip to waveguide transition region 120 of base 110 (see FIGS. 1 and 5).

The oscillator circuit 154 and amplifier/multiplier circuits 156 are typically provided on dielectric substrates, such as a glass or a ceramic (e.g., borosilicate, alumina or beryllium-oxide) material, although a polymer-based substrate could be employed. The launch feature 152 is typically formed on a glass substrate, although other dielectric materials could be used. These substrates are preferably connected to the base 110 by solder or metal-filled adhesive. Epoxy assembly is preferred as it minimizes the impact of any differential between the coefficient of thermal expansion of the base 110 and the coefficient of thermal expansion of the substrates used in connection with the oscillator circuit 154, amplifier/multiplier circuit 156 and launch feature 152. Black lines in this figure represent various bond-wire connections between oscillator circuit 154, amplifier/multiplier circuit 156, launch feature 152, and feed-through pins 112. Wire bonding is typically used to connect the oscillator circuit 154, amplifier/multiplier circuit 156 and launch feature 152 with one another and with pins 112.

Figure 3:
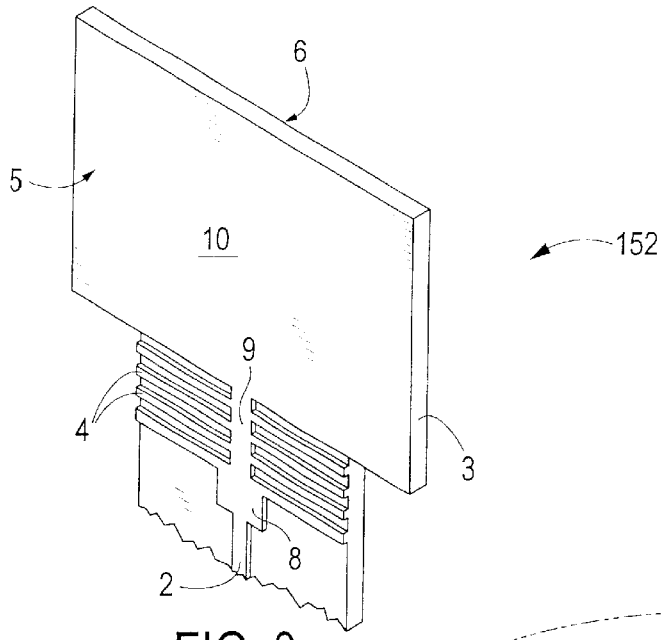
FIG. 3 illustrates microstrip-to-waveguide transition feature used in connection with an embodiment of the present invention.
Figure 4:
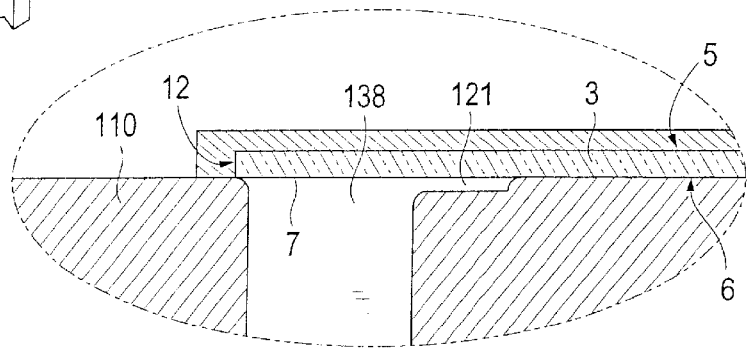
FIG. 4 illustrates a partial cross-section of a launch feature positioned over the microstrip to waveguide transition region of the surface mounted mm-wave source base, according to an embodiment of the present invention.

Details of the launch feature 152 (FIG. 3) and the microstrip-to-waveguide transition region 120 (FIG. 1) will now be described in more detail. Referring to FIGS. 3 and 4, there is shown a portion of an embodiment of a launch feature 152 (FIG. 3), which, in combination with the microstrip-to-waveguide transition region 120 (FIG. 1), acts to convert a mm-wave electrical signal carried by the planar transmission line 2 (FIG. 3) (typically a microstrip line or a coplanar line) into a waveguide signal.

The launch feature 152 (FIG. 3) preferably comprises a 5-mil thick glass substrate 3 (FIG. 3 & FIG. 4), whose surface is patterned with an electrically conductive substrate. Acceptable conductive materials for this purpose include, for example, sputtered or plated gold or copper. Patterned in the electrically conductive material on a first major surface 5 (FIG. 3 & FIG. 4) of the glass substrate 3 (FIG. 3 & FIG. 4) are the planar transmission line sections 2 (FIG. 3) and 8 (FIG. 3), a conversion portion 9 (FIG. 3) with transforming fins 4 (FIG. 3), and rectangular waveguide mode portion 10 (FIG. 3). The conversion portion 9 (FIG. 3) with transforming fins 4 (FIG. 3) operates to convert a quasi-TEM signal carried by the planar transmission line 2 (FIG. 3) into a rectangular waveguide mode signal carried within the glass substrate 3 (FIG. 3 & FIG. 4). For a 76 GHz device, preferred dimensions are as follows:

a.) the central portion of the conversion region 9 (FIG. 3) is typically 550 microns in length and 80 microns in width, and b.) the transforming fins 4 (FIG. 3) are each typically 660 microns in length and 50 microns in width, and are spaced from one another by a distance of 50 microns, and c.) the rectangular waveguide mode portion 10 (FIG. 3) is typically 2000 microns in length and 2300 microns in width.

The glass substrate 3 is also plated with the conductive material on all minor surfaces (minor surface 12 is shown in FIG. 4). As previously noted first major surface 5 of the launch feature 152 comprises the quasi-TEM portions 2 and 8, the conversion portion 9 with transforming fins 4, and the rectangular waveguide mode portion 10 (FIG. 2). A second major surface 6 (opposite surface 5—see FIG. 4) is also adjacent a conductive material except for a rectangular portion that comprises the waveguide access port 7 (FIG. 4). The waveguide access port 7 constitutes a rectangular section of the glass substrate 3 that is unobstructed by a conductive metal, permitting mm-wavelength energy to radiate from the glass substrate 3 and into shallow step region 121 and rectangular waveguide 138 formed in the base 110, as seen in FIG. 4. For a 76 GHz source, preferred dimensions of the access port 7 are 2000 microns in length (the horizontal dimension of FIG. 4) by 2300 microns in width (the dimension of FIG. 4 projecting into the page).

The shallow step region 121 of the base 110 cooperates with the launch feature 152 to impedance match the rectangular waveguide formed in the glass substrate into the region 138. This region 121 is preferably 170 microns in depth (the vertical dimension of FIG. 4), 1000 microns in length (the horizontal dimension of FIG. 4), and 2300 microns in width (the dimension of FIG. 4 projecting into the page) for a 76 GHz signal source. The well at the right-hand end of the shallow step region 121 corresponds to a portion of rectangular waveguide 138, which is preferably dimensioned 1000 microns in length (the horizontal dimension of FIG. 4), and 2300 microns in width (the dimension of FIG. 4 projecting into the page) for a 76 GHz signal source. As seen in FIG. 4, the launch feature 152 is positioned on a surface of the base 110 such that the access port 7 is aligned over shallow step region 121 and rectangular waveguide 138. The waveguide 138 extends to the reflector 136 on the opposite side of the base 110 (see FIG. 9).

Additional details regarding the launch feature 152 and information about the conversion of a signal from a quasi-TEM to a rectangular waveguide mode can be found in U.S. Pat. No. 6,087,907 the entire disclosure of which is hereby incorporated by reference.

Figure 5:
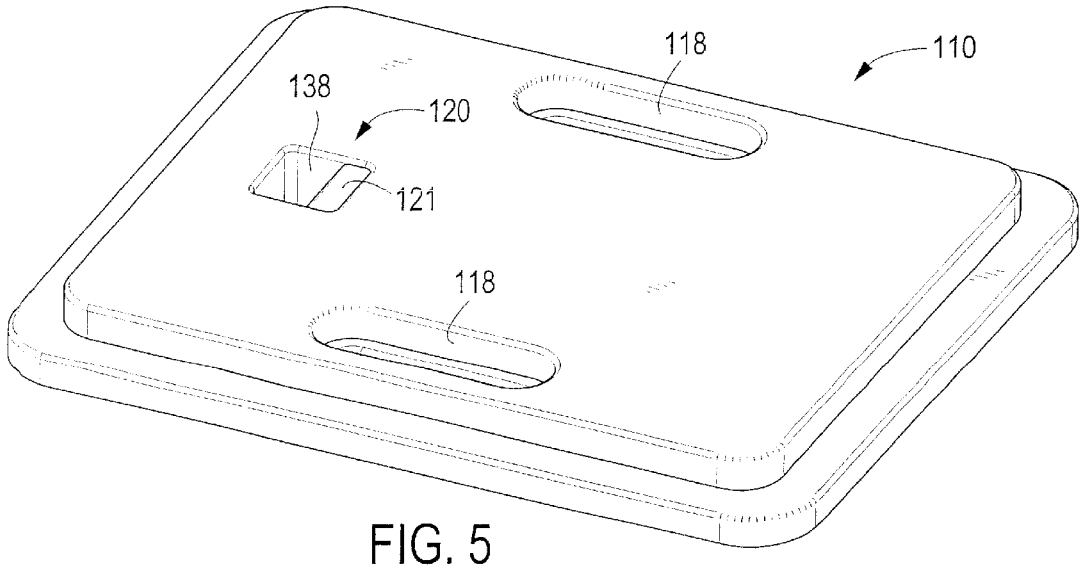
FIG. 5 illustrates the upper surface of the surface mounted mm-wave source base, according to an embodiment of the invention.

A view of the top side of base 110 is found in FIG. 5, which shows the microstrip-to-waveguide transition region 120 of base 110. The shallow step region 121 and the rectangular waveguide 138 formed in the base 110 can be seen. Also seen are slots 118, which receive the dielectric inserts 114 for the feed-through connectors (not shown).

Figure 6:
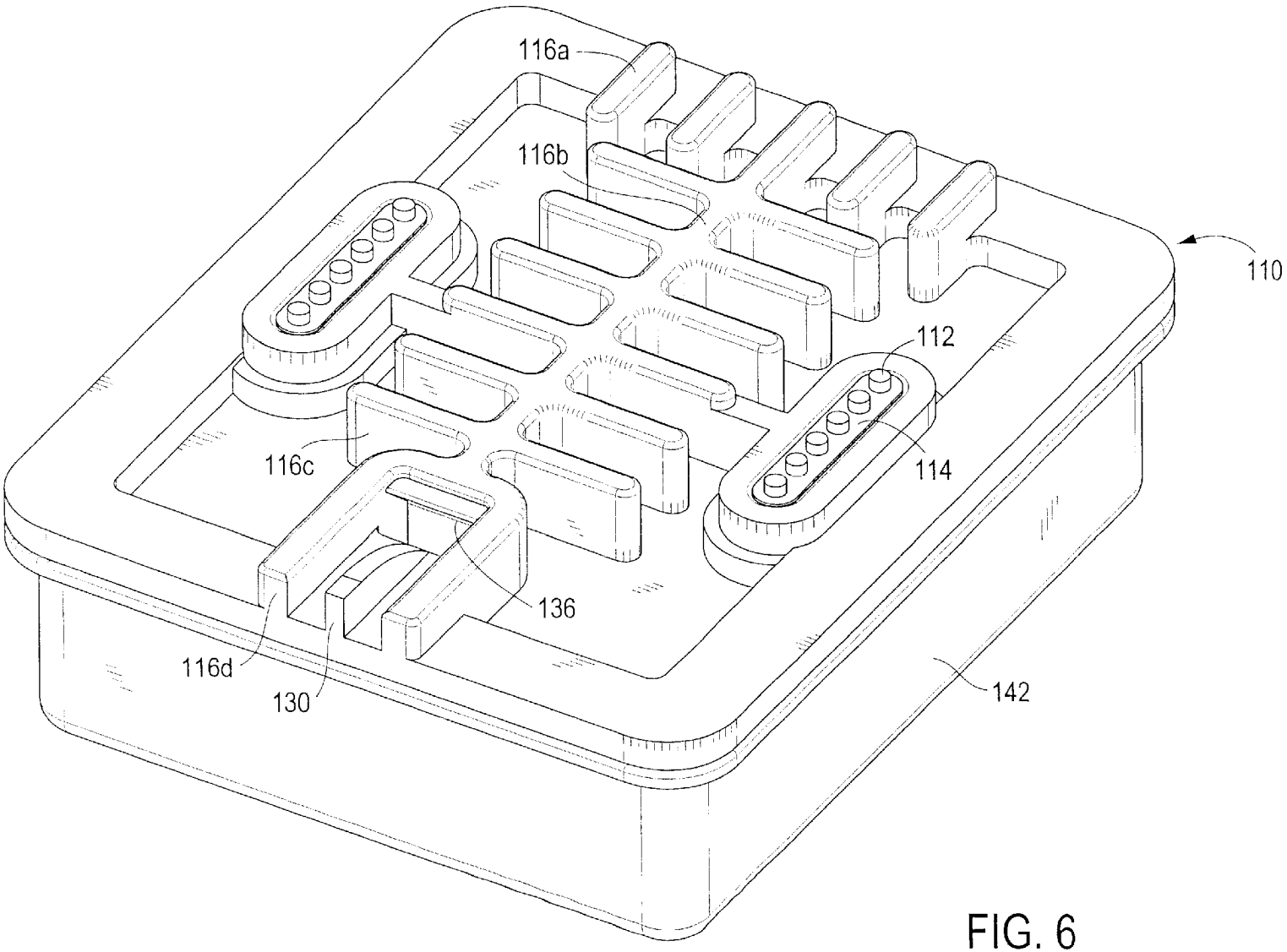
FIG. 6 illustrates a bottom view of the surface mounted mm-wave source of FIG. 1, after assembly of the components shown in FIG. 1.

A view of the bottom side of base 110 is shown in FIG. 6, which illustrates the surface mounted mm-wave source of the present invention after assembly of the components shown in FIG. 1. The cover 142 is attached to the top side of the base 110 via the conductive seal 140 (not shown) and covers the mm-wave circuit components 150 (also not shown). Feed-through pins 112 and dielectric inserts 114 are shown in this figure. Also shown as an integrated part of the base 110 are six parallel projections 116*c*, along with a single large orthogonal projection 116*b* and four additional orthogonal parallel projections 116*a*. Each of these projections 116*a*, 116*b*, 116*c* is designed to conduct heat away from the mm-wave circuitry enclosed by the cover 142 and into the printed circuit substrate (not shown), typically through a via-grounded metal pattern on a printed circuit board to which the source is to be attached. Projections 116*a*, 116*b*, 116*c* are used, rather than a single monolithic heat path, based on the constraints of the preferred metal injection molding process. Specifically, by using projections 116*a*, 116*b*, 116*c*, the cross sectional area of the base is decreased, reducing the amount of metal in the base and as well as the time required for molding. Moreover, the reduced metal in the base also decreases the amount of time required to heat the base 110, for example, in connection with solder reflow.

Projection 116*d*, which is in the shape of a horseshoe, conducts heat in the same fashion as projections 116*a*, 116*b*, 116*c*. Projection 116*d*, however, also serves to electrically shield the waveguide to microstrip transition feature 130 and reflector 136. The region proximate the waveguide to microstrip transition feature 130 is discussed further below in FIGS. 7 and 8.

Figure 12:
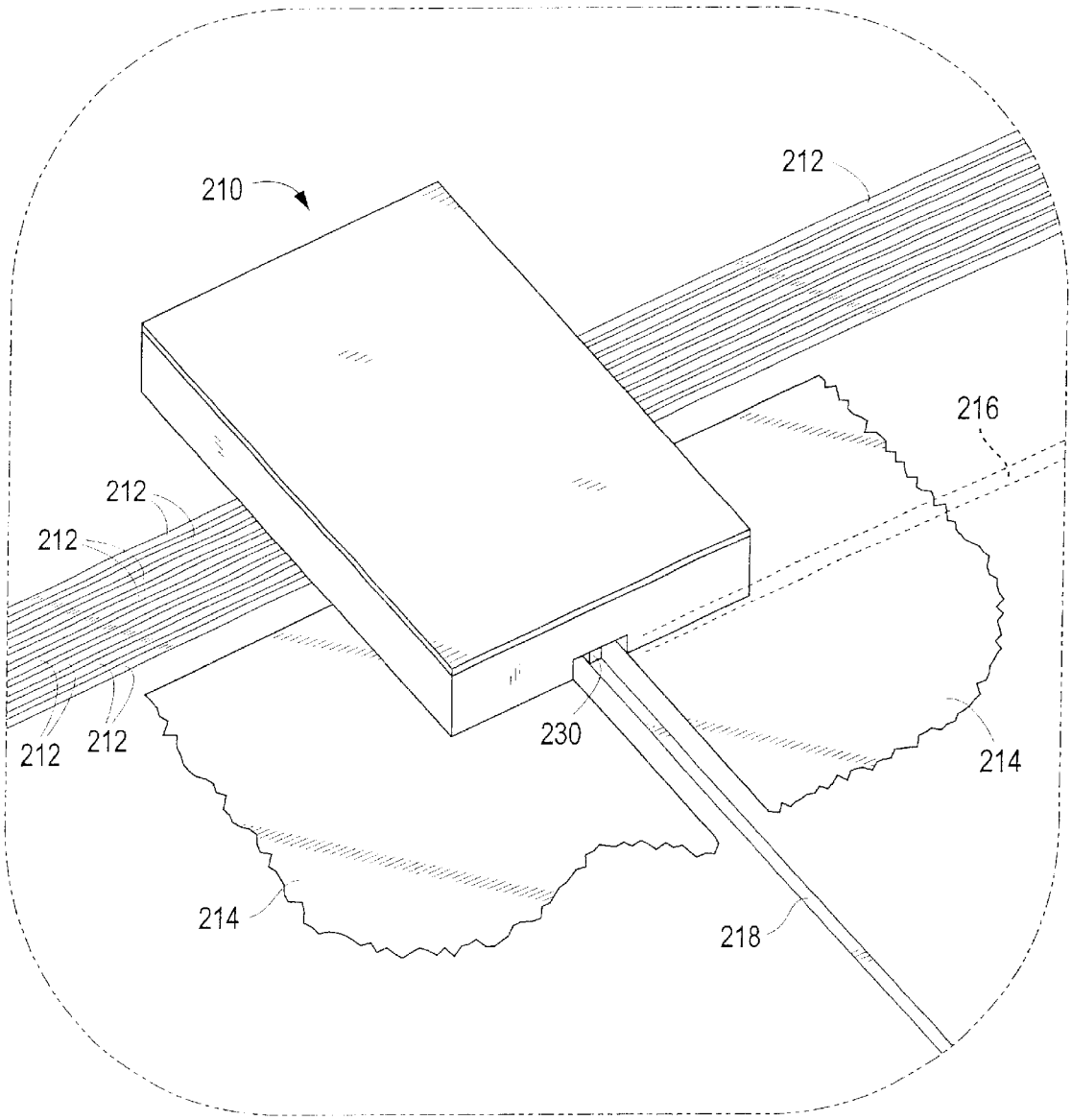
FIG. 12 is a schematic representation of a surface mounted mm-wave source mounted to a printed circuit board in accordance with an embodiment on of the present invention.

According to a preferred embodiment, the highest surfaces (i.e., the highest surfaces of each of the projections 116*a*, 116*b*, 116*c*, the highest surfaces of each of the conductive pins 112 and the apex of the waveguide-to-microstrip transition feature 130) are provided with a layer of solder. A preferred solder for this purpose is a tin-lead alloy although other alloys could be used. At the same time, the substrate to which the surface mounted mm-wave source is to be attached (for example a printed circuit board) is also preferably provided with metallization that is complementary to these highest surfaces. Such a printed circuit board is shown in FIG. 12, in which is a schematic representation of a surface mounted mm-wave source 210 mounted to a printed circuit board in accordance with an embodiment on the present invention. Although the circuit board is transparent, its presence is apparent from the metallization on its surface. Portions of the following metallization are shown:

a.) metallization for power and/or control signals 212 opposite the conductive pins (all eight are numbered on the left, while only a single one is numbered on the right).

B.) metallization for shielding and thermal transfer 214 opposite projections 116*a*, 116*b*, 116*c* (typically via-grounded to metallization 216 on the opposite side of the circuit board), and c.) radio-frequency signal metallization 218 (typically a planar transmission line such as a microstrip line or coplanar line structure, and more preferably a microstrip line) opposite the apex of the waveguide to microstrip transition feature 230.

This arrangement allows the circuit board to be accurately aligned with the surface mounted mm-wave source. For instance, the source can be first placed on the board in a position where the complementary features are approximately matched. Then, the resulting assembly is heated to the melting point of the solder (typically referred to as the tension effects associated with the melted solder will cause the surface mounted mm-wave source to come into proper alignment with the printed circuit board. Accurate centering is particularly beneficial in connection with the attachment of the waveguide to microstrip transition feature 130 to the microstrip metallization of the circuit board.

Figure 7:
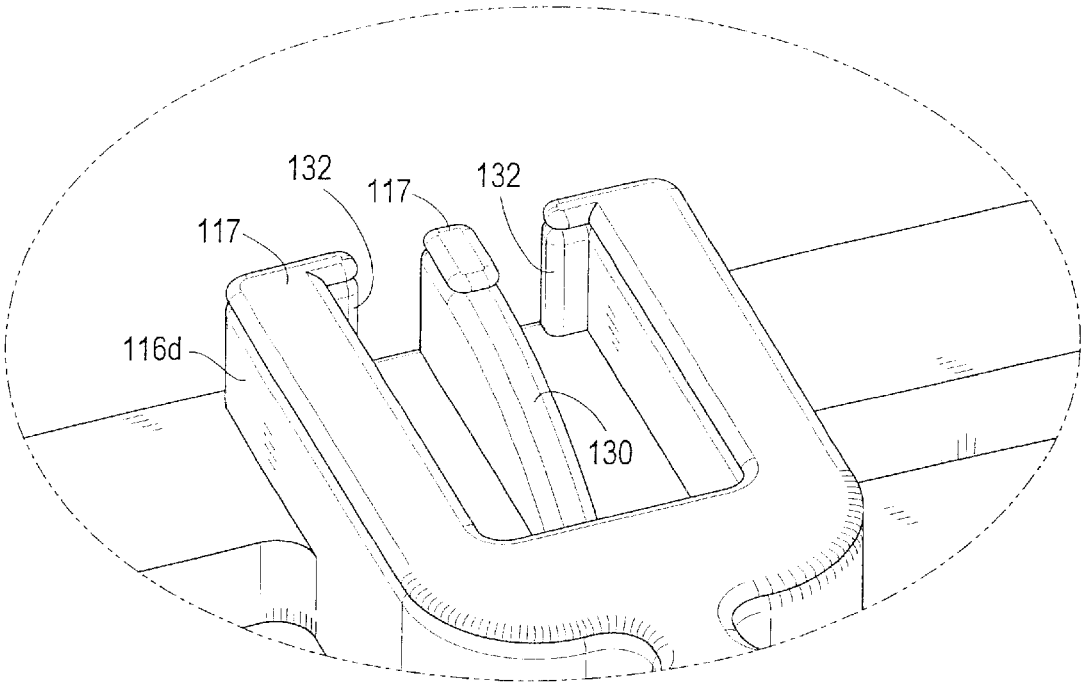
FIGS. 7 and 8 illustrate the waveguide-to-microstrip transition feature region of the surface mounted mm-wave source base, according to an embodiment of the present invention.
Figure 8:
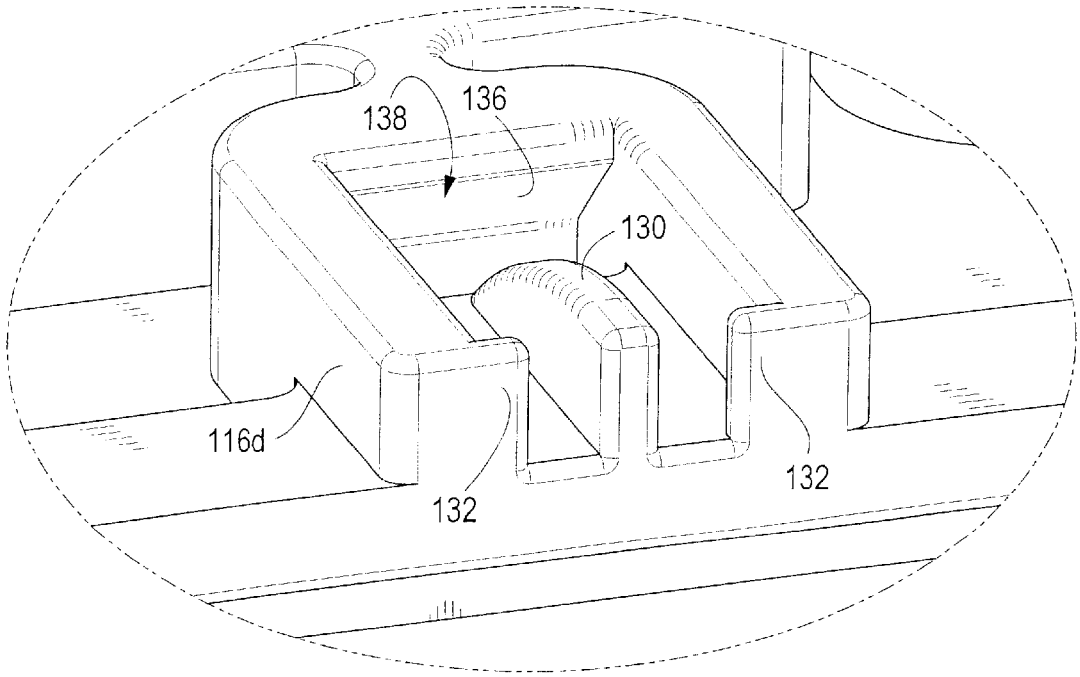

The region surrounding the waveguide-to-microstrip transition feature 130 of the base 110 is shown in FIGS. 7 and 8. These figures show a tapered waveguide to microstrip transition feature 130 (in FIG. 7, the apex of the transition feature 130, as well as that of projection 116*d* and shielding features 132, are shown covered with a layer of solder 117). The waveguide-to-microstrip transition feature 130 is almost completely surrounded by projection 116*d*, which conducts heat and provides shielding as noted above. In contrast to FIG. 6, the projection 116*d* of FIGS. 7 and 8 is provided with additional shielding features 132.

In general, the corners shown in FIGS. 7 and 8 are provided with a 5-mil bending radius. Moreover, the vertical surfaces are provided wit a 0.5 degree tooling taper. However, the back inside surface of projection 116*d* is provided with a 45-degree reflector portion 136, as shown in FIG. 8. This reflector acts to reflect the waveguide mode signal traveling down the rectangular waveguide 138 (FIG. 8), in the direction of the tapered waveguide-to-microstrip transition feature 130.

Figure 9:
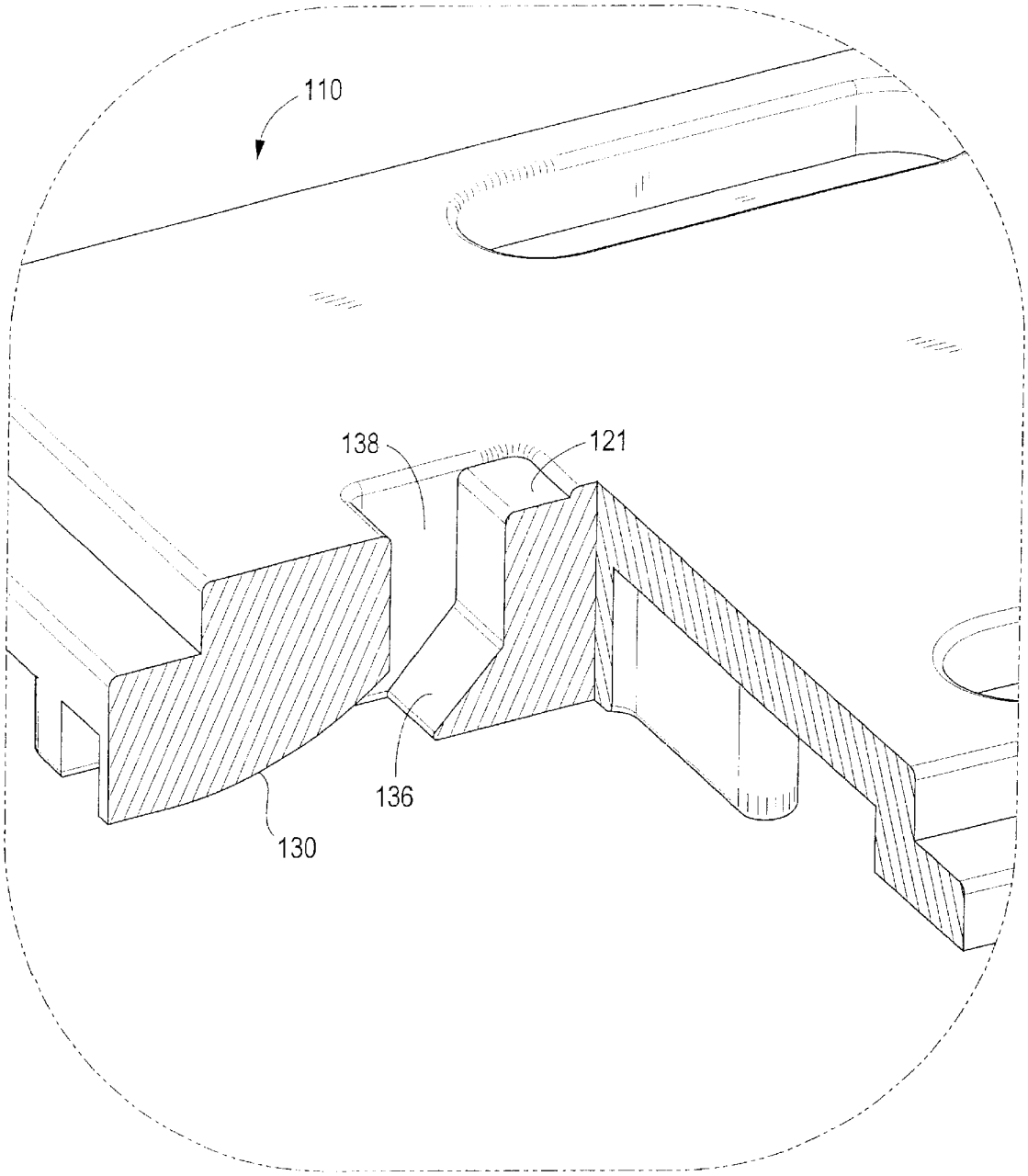
FIG. 9 is a partial cross-sectional view of the surface mounted mm-wave source base, according to an embodiment of the present invention.

FIG. 9 is a partial cross-sectional view of the base 110, which more clearly shows the relative arrangement of the shallow step region 121, rectangular waveguide 138, reflector 136 and tapered ridge transition feature 130.

The transition from a waveguide to a planar radio-frequency transmission line, such as a microstrip line, is a known problem in microwave engineering. Ridge-waveguide design is one of the techniques that can be used to design the transition feature 130 from the waveguide within the base 110 and to a microstrip on a substrate. Described here is a methodology, based on tapered transmission line theory, for the design of the profile of the ridge of the tapered waveguide to microstrip transition feature 130.

Figure 11:
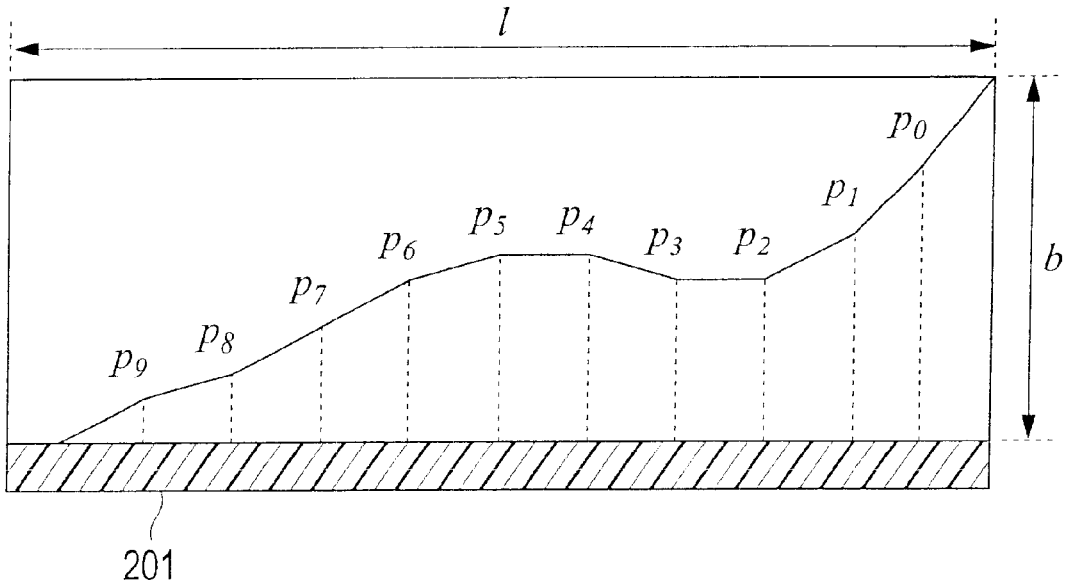
FIG. 11 is a cross-sectional representation (orthogonal to the cross-sectional representation of FIG. 10) that is used for mathematically modeling the ridged waveguide-to-microstrip transition.

The aim of the design is to determine the optimum profile of the ridge shown in FIG. 11. The design is based on analytical determination of the ridge profile and a following verification using full-wave electromagnetic simulators.

Figure 10:
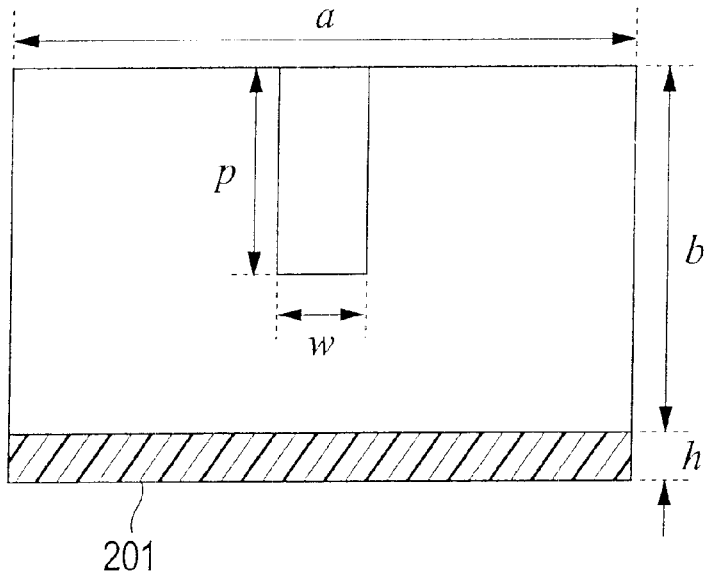
FIG. 10 is a cross-sectional representation of the ridged waveguide section used in the waveguide-to-microstrip transition region, according to an embodiment of the present invention.

The first step of the technique is the determination of characteristic impedance of the dielectric-loaded ridge-waveguide of width, a, and height, b, with a ridge of width, w, for different ridge heights, p, as shown in FIG. 10. A dielectric layer 201 of height h is also included in to the simulations, which corresponds to the dielectric substrate of the microstrip line of the printed circuit board.

FIG. 11 is a side view of the arrangement shown in FIG. 10 and illustrates a third dimension 1. The right hand side of FIG. 11 terminates at or near the rectangular waveguide 138, which extends through the base 110 (not shown in FIG. 11). The left hand side of FIG. 11 terminates at the microstrip on the dielectric substrate 201. While the profile of the ridge is defined by using 10 geometric points in FIG. 11, it is possible to use more points to increase the accuracy of the simulations. The height of ridge at each point is found according to the impedance value required at that section.

The ridge-waveguide is simulated using a full-wave electromagnetic simulator and the characteristic impedance of the waveguide, $Z_0$, is found as a function of the ridge height. Then, p is expressed as a function of the $Z_0$ through a suitable polynomial fitting. An expression in the following form is appropriate for this purpose:

$$p=a_2 \cdot Z_0^2+a_1 \cdot Z_0+a_0 \quad (1)$$

The unknown coefficients in the above expression are found through a least-squares curve-fitting algorithm. Characteristic impedance of each transversal section of the ridge-waveguide required to make a smooth transition between the waveguide and microstrip line is then determined according to following expression:

$$Z_0 = \begin{cases} e^{[2(z/l)^2]\ln(Z_L)} & 0 \le z \le \frac{l}{2} \\ e^{[4z/l-2(z/l)^2-1]\ln(Z_L)} & \frac{l}{2} \le z \le l \end{cases} \quad (2)$$

where l and z are the total length of the ridge and position along the ridge, respectively. $\overline{Z}_l$. is the normalized load impedance, which corresponds to the normalized impedance of the waveguide found at p=0 through the full-wave simulation. The above expression is for a taper with triangular distribution. It is also possible to use a taper with exponential distribution whose definition is given below:

$$Z_0 = e^{(z/l)\ln(Z_L)} 0 \le z \le l \quad (3)$$

After obtaining $Z_0$ at each discretized position along the ridge using Equations (2) or (3), Equation (1) is used to translate the required impedance values to the height of points along the ridge as shown in FIG. 11. This completes the design of the transition.

For a 76 GHz signal, the parameters a, b, w, and h can be selected as 90, 50, 22 and 8 mils, respectively. Typically the Duroid material having relative dielectric constant 2.2 is used as the substrate material. The total length of the transition region, l, is chosen to be at least one wavelength at the operating frequency (i.e., 76 GHz). For a 76 GHz device, l can be 170 mils. In this case, the following expression can be obtained for the characteristic impedance of the ridged waveguide:

$$p = 0.000302 \cdot Z_0^2 - 0.28 \cdot Z_0 + 61.9 \quad (4)$$

After inserting the impedance values found from Equation (2) or (3) into Equation (4), the following tabulated values for p dimension are obtained. These values correspond to the vertical distances ($p_9$, $p_8$, . . . , $p_0$) from top of the waveguide as shown in FIG. 11. After determining the p values, the design process is completed by linearly interpolating between the points, which gives the profile of the ridge. Note that selection of type of the taper (i.e., exponential or triangular) depends on the impedance bandwidth requirements. It is also possible to select a different tapering.

| Normalized Length | Normalized Impedance (Exponential Taper) | Normalized Impedance (Triangular Taper) | Impedance (Exponential Taper) | Impedance (Triangular Taper) | p (mils) |
|---|---|---|---|---|---|
| 0 | 1.00 | 1.00 | 50 | 50 | 48.7 |
| 0.1 | 1.22 | 1.04 | 61 | 52 | 48.2 |
| 0.2 | 1.48 | 1.17 | 74 | 58 | 46.6 |
| 0.3 | 1.80 | 1.42 | 90 | 71 | 43.5 |
| 0.4 | 2.19 | 1.87 | 110 | 94 | 38.3 |
| 0.5 | 2.66 | 2.66 | 133 | 133 | 29.9 |
| 0.6 | 3.24 | 3.79 | 162 | 190 | 19.6 |
| 0.7 | 3.94 | 4.99 | 197 | 249 | 10.8 |
| 0.8 | 4.80 | 6.07 | 240 | 303 | 4.7 |
| 0.9 | 5.84 | 6.83 | 292 | 341 | 1.4 |
| 1 | 7.10 | 7.10 | 355 | 355 | 0.5 |

Although various embodiments are specifically illustrated and described herein, it will be appreciated that modifications and variations of the present invention are covered by the above teachings and are within the purview of the appended claims without departing from the spirit and intended scope of the invention.

What is claimed is:

1. A surface-mounted mm-wave signal source comprising:

a conductive metal base;

a mm-wave signal source disposed over an upper portion of said metal base;

a first radio frequency transmission line disposed over said upper portion of said metal base and.proximate said signal source, said transmission line carrying a quasi-TEM signal from said mm-wave signal source;

a first mode transformer at least partially integrated into said upper portion of said metal base to convert said quasi-TEM signal carried by said planar transmission line into a rectangular waveguide mode signal;

a waveguide well having upper and lower ends disposed within said base for carrying said rectangular waveguide mode signal from said upper portion of said base to a lower portion of said base;

a second mode transformer at least partially integrated into said lower portion of said base to convert said rectangular waveguide mode signal to a quasi-TEM signal within a second radio frequency transmission line oriented perpendicularly to said waveguide well.

2. The surface-mountable mm-wave signal source of claim 1, wherein said mm-wave signal source, said first radio frequency transmission line and said mode transformer are disposed within a metal cover over said upper portion of said base.

3. The surface-mountable mm-wave signal source of claim 2, wherein said metal cover is attached to said base by a solder or by a conductive adhesive.

4. The surface-mountable mm-wave signal source of claim 1, wherein said mm-wave signal source, said first radio frequency transmission line and at least portions of said first mode transformer are disposed on at least one dielectric substrate that is attached to said base.

5. The surface-mountable mm-wave signal source of claim 4, wherein said one or more dielectric substrates is attached to said base by a conductive epoxy.

6. The surface-mountable mm-wave signal source of claim 1, wherein said first mode transformer comprises a glass substrate provided with a layer of patterned electrically conductive material and disposed over both (a) a shallow step region in an upper surface of said base and (b) said upper end of said waveguide well.

7. The surface-mountable mm-wave signal source of claim 6, wherein said patterned electrically conductive material comprises transforming fins for converting said quasi-TEM signal into said rectangular waveguide mode signal.

8. The surface-mountable mm-wave signal source of claim 1, further comprising a plurality of projections integrated into a lower surface of said base.

9. The surface-mountable mm-wave signal source of claim 1, wherein the metal in the base is selected from the group consisting of (a) 85% tungsten/15% copper alloy, (b) 94% tungsten/2% nickel/2% copper alloy, and (c) a stainless steel alloy.

10. The surface-mountable mm-wave signal source of claim 1, wherein the base is formed by metal injection molding.

11. The surface-mountable mm-wave signal source of claim 1, wherein said second mode transformer comprises an angled reflector and a tapered ridge transition, said angled reflector being disposed at said lower end of said waveguide well and reflecting said waveguide mode signal onto said tapered ridge transition, said tapered ridge transition shaped to convert said rectangular waveguide mode signal to a quasi-TEM signal within an adjacent microstrip line.

12. The surface-mountable mm-wave signal source of claim 11, wherein said angled reflector and said tapered ridge transition are integrated into said base.

13. The surface-mountable mm-wave signal source of claim 11, further comprising a plurality of projections integrated into a lower portion of said base.

14. The surface-mountable mm-wave signal source of claim 13, wherein said angled reflector and said tapered ridge transition are substantially surrounded by at least one of said projections.

15. The surface-mountable mm-wave signal source of claim 14, further comprising at least one feed-through by which power or control signals can be transmitted between said lower portion of said base and said upper portion of said base.

16. The surface-mountable mm-wave signal source of claim 15, wherein a lower surface of said tapered ridge transition, lower surfaces of said feed-throughs and lower surfaces of said projections are provided with a layer of solder.

17. The surface-mountable mm-wave signal source of claim 1, wherein said mm-wave signal source operates in a frequency range of from 35 to 94 GHz.

18. The surface-mountable mm-wave signal source of claim 1, wherein said mm-wave signal source operates in a frequency range of 70 to 80 GHz.

19. The surface-mountable mm-wave signal source of claim 1, wherein said first radio frequency transmission line is a first microstrip line disposed on a dielectric substrate.

20. The surface-mountable mm-wave signal source of claim 1, further comprising at least one feed-through by which power or control signals can be transmitted between said lower portion of said base and said upper portion of said base.

21. The surface-mountable mm-wave signal source of claim 20, wherein said feed-through further comprises a conductive pin disposed within a dielectric insert, and wherein said dielectric insert occupies a slot disposed between said upper and lower portions of said base.

22. A mm-wave electronic circuit comprising: the surface-mountable mm-wave signal source of claim 1, and a printed circuit board comprising said second radio frequency transmission line, said surface-mountable package being coupled to said printed circuit board.

23. The mm-wave electronic circuit of claim 22, wherein said second radio frequency transmission line is a microstrip line disposed on said printed circuit board.

24. The mm-wave electronic circuit of claim 23, wherein said second mode transformer comprises an angled reflector and a tapered ridge transition, and wherein (a) said angled reflector is disposed at the lower end of said waveguide slot and reflects said rectangular waveguide mode signal to said tapered ridge transition, (b) said tapered ridge transition is coupled to said microstrip line disposed on said printed circuit board, (c) said tapered ridge transition acts to convert said rectangular waveguide mode signal into a quasi-TEM signal within said microstrip line disposed on said printed circuit board.

25. The mm-wave electronic circuit of claim 24, wherein said base further comprises at least one feed-through by which power or control signals can be transmitted between said lower portion of said base and said upper portion of said base.

26. The mm-wave electronic circuit of claim 25, wherein said circuit board further comprises metallization for power or signal transmission and metallization for grounding and heat transfer, said metallization for power or signal transmission being coupled to said at least one feed-through and said metallization for grounding and heat transfer being coupled to said base.

27. The mm-wave electronic circuit of claim 26, wherein solder is used: (a) to couple said tapered ridge transition to said microstrip line disposed on said printed circuit board, (b) to couple said at least one feed-through to said metallization for power or signal transmission, and (c) to couple said base to said metallization for grounding and heat transfer.

28. The mm-wave electronic circuit of claim 26, wherein conductive adhesive is used: (a) to couple said tapered ridge transition to said microstrip line disposed on said printed circuit board, (b) to couple said at least one feed-through to said metallization for power or signal transmission, and (c) to couple at least portions of said base to said metallization for grounding and heat transfer.

* * * * *